US010580562B2

(12) United States Patent
Neudecker

(10) Patent No.: US 10,580,562 B2
(45) Date of Patent: Mar. 3, 2020

(54) INDUCTIVE COMPONENT AND METHOD FOR PRODUCING AN INDUCTIVE COMPONENT

(71) Applicant: EPCOS AG, Munich (DE)

(72) Inventor: Martin Neudecker, Munich (DE)

(73) Assignee: EPCOS AG, Munich (DE)

( * ) Notice: Subject to any disclaimer, the term of this patent is extended or adjusted under 35 U.S.C. 154(b) by 47 days.

(21) Appl. No.: 15/560,848

(22) PCT Filed: Mar. 1, 2016

(86) PCT No.: PCT/EP2016/054323
§ 371 (c)(1),
(2) Date: Sep. 22, 2017

(87) PCT Pub. No.: WO2016/155969
PCT Pub. Date: Oct. 6, 2016

(65) Prior Publication Data

US 2018/0114625 A1 Apr. 26, 2018

(30) Foreign Application Priority Data

Mar. 27, 2015 (DE) ..... 10 2015 104 794

(51) Int. Cl.

| | |
|---|---|
| ***H01F 27/26*** | (2006.01) |
| ***H01F 27/06*** | (2006.01) |
| ***H01F 41/061*** | (2016.01) |
| ***H01F 27/24*** | (2006.01) |
| ***H01F 27/28*** | (2006.01) |
| *H01F 27/29* | (2006.01) |
| *H01F 41/08* | (2006.01) |

(52) U.S. Cl.
CPC ..... *H01F 27/06* (2013.01); *H01F 27/24* (2013.01); *H01F 27/266* (2013.01); *H01F 27/2823* (2013.01); *H01F 41/061* (2016.01); *H01F 27/2828* (2013.01); *H01F 27/292* (2013.01); *H01F 41/08* (2013.01); *H01F 2027/297* (2013.01)

(58) Field of Classification Search
CPC ..... H01F 27/06; H01F 27/24; H01F 27/2823
USPC ..... 336/83, 90, 196, 197, 198, 208, 210
See application file for complete search history.

(56) References Cited

U.S. PATENT DOCUMENTS

| | | | | |
|---|---|---|---|---|
| 2,230,898 A | | 2/1941 | MacFadden | |
| 2,741,528 A | * | 4/1956 | Clark | H01F 27/06 174/DIG. 2 |
| 3,346,828 A | | 10/1967 | Buschman | |
| 4,882,561 A | * | 11/1989 | Fujioka | H04B 15/00 336/65 |
| 5,274,907 A | | 1/1994 | Moorehead | |

(Continued)

FOREIGN PATENT DOCUMENTS

| | | |
|---|---|---|
| AU | 7459374 A | 4/1976 |
| DE | 1287216 A | 1/1969 |

(Continued)

*Primary Examiner* — Tszfung J Chan
(74) *Attorney, Agent, or Firm* — Slater Matsil, LLP

(57) ABSTRACT

An inductive component and a method for producing an inductive component are disclosed. In an embodiment the inductive component includes a mounting device, a magnetic core, at least one winding of a wire wound around the magnetic core and a latching device, wherein the core is secured to the mounting device by the latching device.

12 Claims, 2 Drawing Sheets

(56) References Cited

U.S. PATENT DOCUMENTS

| | | | | |
|---|---|---|---|---|
| 5,331,729 | A | 7/1994 | Moorehead | |
| 2002/0079999 | A1 | 6/2002 | Abdel-Tawab et al. | |
| 2005/0258926 | A1* | 11/2005 | Weger | H01F 17/045 336/212 |
| 2006/0273873 | A1* | 12/2006 | Chen | H01F 17/045 336/200 |
| 2007/0241850 | A1 | 10/2007 | Watanabe | |
| 2011/0026917 | A1 | 2/2011 | Li et al. | |
| 2012/0066897 | A1 | 3/2012 | Hiramatsu et al. | |
| 2012/0146756 | A1 | 6/2012 | Roellgen et al. | |
| 2013/0154782 | A1* | 6/2013 | Won | H01F 5/02 336/192 |
| 2016/0268043 | A1 | 9/2016 | Frey et al. | |

FOREIGN PATENT DOCUMENTS

| | | | | |
|---|---|---|---|---|
| DE | 3613862 | A1 | 10/1987 | |
| DE | 4239818 | A1 | 6/1994 | |
| DE | 19707177 | A1 * | 9/1998 | H01F 27/255 |
| DE | 10117846 | C1 | 2/2003 | |
| DE | 102004037853 | A1 | 3/2006 | |
| DE | 102005027942 | A | 12/2006 | |
| DE | 102006026364 | A1 | 8/2007 | |
| DE | 102011075901 | A1 | 11/2012 | |
| EP | 0246029 | A2 | 5/1987 | |
| EP | 0809264 | A1 | 11/1997 | |
| EP | 1752997 | A1 | 2/2007 | |
| FR | 1592711 | A | 6/1970 | |
| FR | 2494489 | A1 | 5/1982 | |
| GB | 740572 | A | 5/1953 | |
| GB | 740572 | A * | 11/1955 | H01F 27/06 |
| JP | S56118350 | A | 9/1981 | |
| JP | S57165725 | A | 10/1982 | |
| JP | S58025014 | A | 2/1983 | |
| JP | S5970324 | A | 4/1984 | |
| JP | H0198723 | A | 4/1989 | |
| JP | H01091552 | A | 4/1989 | |
| JP | H0330410 | A | 2/1991 | |
| JP | H0338605 | U | 4/1991 | |
| JP | 2001052945 | A | 2/2001 | |
| JP | 2002208517 | A | 7/2002 | |
| JP | 2002260933 | A | 9/2002 | |
| JP | 2004327461 | A | 11/2004 | |
| JP | 2006173201 | A | 6/2006 | |
| JP | 2008005171 | A | 1/2008 | |
| JP | 2009094476 | A * | 4/2009 | |
| JP | 2009094476 | A | 4/2009 | |
| JP | 2010165795 | A | 7/2010 | |
| JP | 2013501369 | A | 1/2013 | |
| JP | 2017500737 | A | 1/2017 | |
| WO | 2005119709 | A1 | 12/2005 | |
| WO | 2010109930 | A1 | 9/2010 | |
| WO | 2011014044 | A2 | 2/2011 | |
| WO | 2015075261 | A | 5/2015 | |

* cited by examiner

INDUCTIVE COMPONENT AND METHOD FOR PRODUCING AN INDUCTIVE COMPONENT

This patent application is a national phase filing under section 371 of PCT/EP2016/054323, filed Mar. 1, 2016, which claims the priority of German patent application 10 2015 104 794.2, filed Mar. 27, 2015, each of which is incorporated herein by reference in its entirety.

TECHNICAL FIELD

An inductive component with a magnetic core and at least one winding around the core is specified. The inductive component is embodied, for example, as a current-compensated choke.

BACKGROUND

Automated manufacture of the winding around the core is possible, for example, using thrust wire winding techniques, wherein a wire is fed along a curved wall of a winding apparatus, with the result that the wire is in this case bent and screwed around the core. Usually, the wound core is mounted on a mounting device or a housing is mounted around the core by an adhesive connection or by heat calking. These connection techniques are relatively costly and time-consuming.

SUMMARY OF THE INVENTION

Embodiments of the present invention provide an improved inductive component and an improved method for producing an inductive component.

In accordance with a first aspect of the present invention, an inductive component having at least one winding of a wire around a magnetic core is specified. The component also has a mounting device, to which the core is secured by latching using a latching device.

The inductive component is embodied as a choke, for example. The magnetic core is a ferrite core, for example. In one embodiment, the core is surrounded by a housing. The housing has, in particular, an insulating material, for example, a plastic material. In one alternative embodiment, the core is not surrounded by a housing, with the result that the winding is formed directly around the core.

The winding is preferably produced using thrust wire winding techniques. With these winding techniques, mechanical loading of the core and/or a core housing can be kept particularly low. For example, the winding can be applied without contact to the core or the housing. The risk of damage to the core or the housing and thus the risk of failure of the insulation effect can therefore be kept low.

In one embodiment, the winding loosely sits on the core or on the housing. "Loosely" means, in particular, that the winding is rotatable around the core at least prior to further mounting. For example, a gap is formed between the winding and the core or the housing. However, the winding can also abut the housing or core. A loosely seated winding can be produced, for example, using thrust wire winding techniques.

The mounting device is embodied as a plate, for example. The mounting device can serve, in particular, to fix the position of electrical connections of the inductive component. For example, the mounting device has holes, through which electrical connection elements of the inductive component are fed through.

For example, the mounting device is embodied as a grid plate.

Fastening the core to the mounting device by means of the latching device enables simple and rapid mounting of the core. In particular, adhesive-free fastening is made possible, whereby production time and costs can be saved. The latching device can be embodied as part of the mounting device or secured to the mounting device.

For example, the latching device has one or more latching elements, which latch to the core and/or a housing of the core. The latching elements can be embodied as latching arms. In order to fasten the wound core to the mounting device, said core is placed on the latching device and pressed against the mounting device, for example. In this case, the latching elements are first bent outward and snap into place during latching to the core and/or a housing.

In one embodiment, the latching device engages directly on the magnetic core. In this case, particularly good fixing of the core can be achieved. For example, the core has no housing. Alternatively, the core can have a housing with at least one opening, into which the latching device engages. In an alternative embodiment, the latching device engages on the housing.

In one embodiment, the inductive component has at least two windings. A separating element is preferably arranged between the windings. The separating element serves, in particular, for the insulation of the windings from one another.

The separating element is preferably mounted without adhesive. For example, the separating element is secured to the housing and the mounting device or is embodied as part of the housing or the mounting device.

In one embodiment, the inductive component has at least one connection element for the electrical connection of the component. The connection element is formed by a wire end of a winding, for example. Alternatively, the connection element can be secured to the wire end. The connection element is fed through the mounting plate, for example. The position of the connection element can be fixed in this way.

In one embodiment, the component is embodied for PTH (pin through hole) mounting. In this case, the connection elements are, for example, fed through holes in the mounting device and protrude out of the underside of the mounting device in a pin-like manner. For further mounting, the connection elements can be inserted into holes in a printed circuit board.

In an alternative embodiment, the component is embodied for SMD (surface mounted device) mounting, that is to say, for surface mounting. In this case, the connection elements are, for example, fed through holes in the mounting device and bent on the underside of the mounting device. The component can therefore be placed and surface-mounted on a printed circuit board, for example.

In accordance with a further aspect of the present invention, an inductive component with at least one winding of a wire around a magnetic core is specified. The inductive component has a housing for the core. The housing has a plurality of housing parts, which are held together by the winding. In particular, the housing parts are mounted without adhesive. This allows simple and rapid mounting of the housing. The inductive component is preferably produced using thrust wire winding techniques. The winding preferably sits loosely on the core or the housing. As described above, the core can be secured to a mounting device by means of latching.

In accordance with a further aspect of the present invention, an inductive component with at least one winding of a wire around a magnetic core is specified, wherein the component is produced using thrust wire winding techniques. The inductive component has a component part, which is mounted on the core without adhesive.

In one embodiment, the component part is embodied as a housing for the core. In particular, the housing can be embodied as described above. For example, the housing has a plurality of housing parts, which are held together by the winding.

In a further embodiment, the component part is embodied as a mounting device. The mounting device can be embodied as described above. In particular, the core can be secured to the mounting device by latching using a latching device. The latching device can engage directly on the core or on a housing for the core, for example.

In a further embodiment, the component part is embodied as a separating element, which is arranged between two windings of the component. The separating element can be embodied as described above.

In accordance with a further aspect of the present invention, a method for producing an inductive component is specified. In particular, the method serves for producing one of the components described above. In accordance with the method, a magnetic core is inserted into a winding apparatus and wound with a wire by feeding the wire along a curved wall of the winding apparatus. For example, the wire is wound around the core without contact to the core or to a housing. Mechanical damage to the core and/or the housing can be prevented in this way.

The method also comprises a step in which a component part is mounted on the core without adhesive. Here, the component part can be secured directly to the core or can be secured only indirectly, for example, to a housing. The adhesive-free mounting can be carried out before or after the core is wound.

For example, the component part is embodied as a mounting device for positioning the core, as a housing for the core, or as a separating element of two windings around the core.

For example, the core is inserted into the winding apparatus together with a housing. The housing has, for example, a plurality of housing parts, which abut one another, but are not firmly connected to one another. The fastening of the housing parts to one another is only produced by the winding. The winding operation can be carried out using the thrust wire winding technique without sizeable mechanical loading of the housing. The housing parts can therefore abut one another during the winding process without further securing of the housing parts to one another being necessary. This allows particularly simple and fast production of the component.

After the formation of one or more windings, the core is secured, for example, to a mounting device by latching using a latching device.

In the present disclosure, several aspects of an invention are described. All properties that are disclosed with respect to the component and/or the method are also appropriately disclosed with respect to the respective other aspects and vice versa, even if the respective property is not explicitly mentioned in the context of the particular aspect.

BRIEF DESCRIPTION OF THE DRAWINGS

In the following text, the subjects described here are explained in more detail with reference to schematic exemplary embodiments that are not true to scale, in which.

In the following figures, identical reference numerals preferably refer to functionally or structurally corresponding parts of the different embodiments.

DETAILED DESCRIPTION OF ILLUSTRATIVE EMBODIMENTS

Figure 1A:
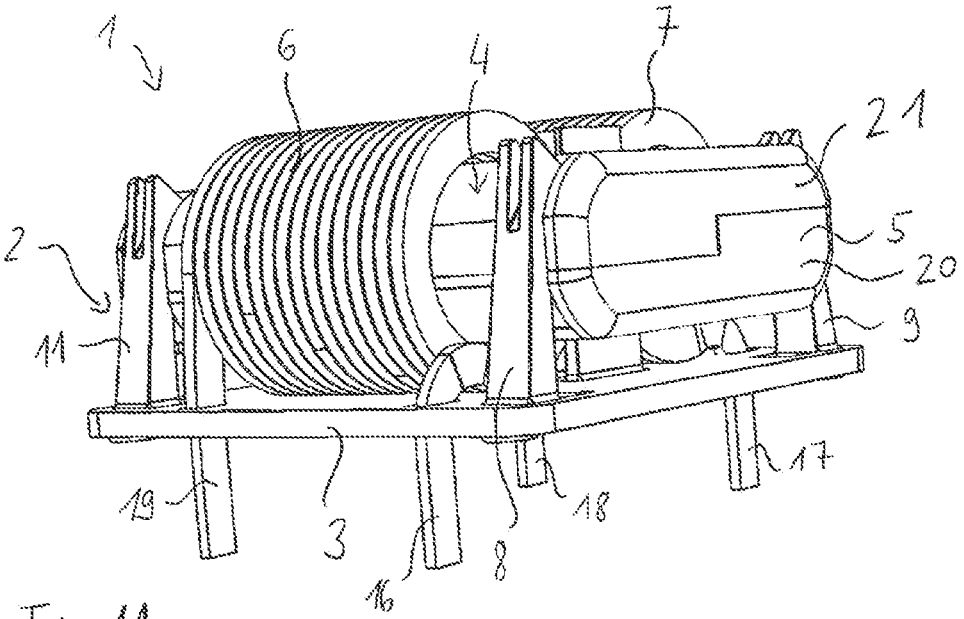
FIGS. 1A and 1B show an embodiment of a component in a side view and in a plan view.
Figure 1B:
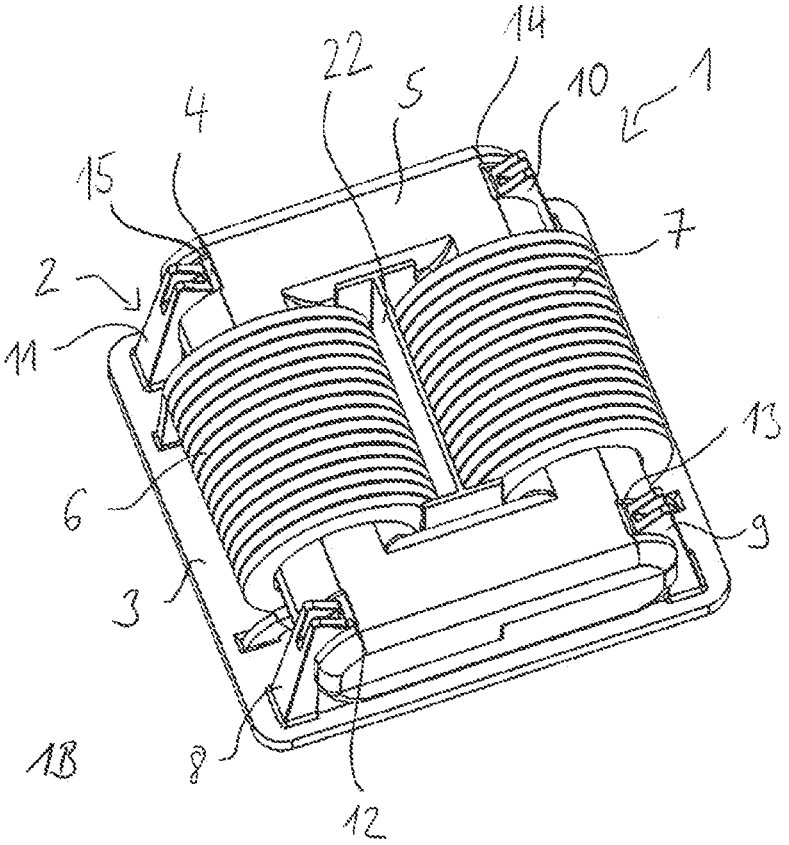

FIG. 1A shows an inductive component 1 in a side view. FIG. 1B shows the component 1 in a plan view.

The component 1 has a mounting device 3. The mounting device 3 is embodied as a plate, for example. In particular, said plate can be a grid plate having a plurality of holes. The mounting device 3 serves, for example, for positioning and fixing parts of the component 1, such as electrical connections, for example.

The inductive component 1 can be used as a passive component and can serve, for example, to attenuate electromagnetic interference. For example, the inductive component 1 can be used as a choke, in particular as a current-compensated choke. The inductive component 1 can also be used as a transformer, for example. Said transformer can be, in particular, a transformer for signal transmission or a power transformer.

The inductive component 1 has a magnetic core 4. In particular, said core is a ferrite core. The core 4 is surrounded by a housing 5. The housing 5 serves here for the insulation of the core 4. The core 4 can therefore preferably be uncoated. In this case, the quality of the component 1 does not depend on the quality of a core coating. It is therefore possible to ensure that the component 1 is suitable for high nominal voltages, for example, for 1000 V DC. The core 4 has a closed shape. In particular, said shape is a rectangular shape.

The inductive component 1 has two windings 6, 7 of a wire around the core 4. The windings 6, 7 are arranged on two opposite sections of the core 4. For example, the windings 6, 7 have a cylindrical shape, in particular the shape of a circular cylinder. The wire is embodied as a flat wire, for example. For example, the turns of the windings 6, 7 closely abut one another, with the result that a high degree of filling is achieved.

The windings 6, 7 are preferably produced using a thrust wire winding technique. This winding technique will be described in detail later.

The core 4 provided with the windings 6, 7 is arranged lying on the mounting device 3. In particular, the longitudinal axes of the windings 6, 7 run parallel to a top side of the mounting device 3. The longitudinal axes correspond in this case to imaginary winding axes, around which the wires are wound.

The inductive component 1 has connection elements 16, 17, 18, 19 for the electrical connection of the component 1. The connection elements 16, 17, 18, 19 are formed, for example, by wire ends of the windings 6, 7. Alternatively, the connection elements 16, 17, 18, 19 can be embodied as separate parts and be secured to the wire ends. The connection elements 16, 17, 18, 19 are guided through holes in the mounting device 3. In particular, the connection elements 16, 17, 18, 19 are designed as PTH connections. In addition to the electrical connection, the connection elements 16, 17, 18, 19 can also serve as supporting legs for the component 1.

The core 4 is secured to the mounting device 3 by a latching device 2. The latching device 2 has a plurality of latching elements 8, 9, 10, 11. The latching elements 8, 9, 10, 11 are fixed to the mounting device 3. The latching elements 8, 9, 10, 11 are embodied as latching arms, which lead upward away from the mounting device 3 and have a slight inclination inward. The latching elements 8, 9, 10, 11 engage on the core 4 from the outside.

For fastening the core 4 to the mounting device 3, the wound core 4 is pressed onto the mounting device 3 against the latching device 2, with the result that the wound core 4 presses the latching elements 8, 9, 10, 11 outward. In an end position of the wound core 4, the latching elements 8, 9, 10, 11 snap inward into place and latch to the core 4.

As can be seen in FIG. 1B, the housing 5 has openings 12, 13, 14, 15, into which the latching elements 8, 9, 10, 11 engage. The latching elements 8, 9, 10, 11 therefore directly abut the core 4. In other embodiments, the latching elements 8, 9, 10, 11 can also abut the housing 5 or the windings 6, 7. In this case, the core 4 is secured only indirectly to the mounting device 3.

The wound core 4 is secured to the mounting device 3 without adhesive by the latching elements 8, 9, 10, 11. The latching elements 8, 9, 10, 11 allow rapid and simple mounting. In particular, complex joining processes, such as heat calking, can be avoided and curing time for curing adhesive bonds can be saved. This enables manual work steps to be saved and thus production time and costs to be reduced.

The inductive component 1 is therefore partially fixed in position by the guiding of the connection elements 16, 17, 18, 19 through holes in the mounting device 3. In addition, the position is determined by the latching using the latching elements 8, 9, 10, 11. The separate fixing of the connection elements 16, 17, 18, 19 and the core 4 is particularly advantageous when the windings 6, 7 only loosely sit on the housing 5. This can be the case, in particular, during the application of the windings 6, 7 using the thrust wire winding technique.

Furthermore, the housing 5 can also have an adhesive-free design, which allows rapid mounting of the housing 5. As can be seen in FIG. 1A, the housing 5 has a first housing part 20 and a second housing part 21. The housing parts 20, 21 are, for example, of identical design. In particular, each housing part 20, 21 has the shape of a half-shell. The housing parts 20, 21 are embodied, for example, as thin plastic parts. It should be ensured here that sufficiently long air gaps and creepage distances are available for high nominal voltages, for example, 1000 V DC.

The housing parts 20, 21 abut one another and are held together here only by the windings 6, 7. The windings 6, 7 abut the housing parts 20, 21 in a form-fitting manner, for example. Such adhesive-free mounting of the housing 5 can be formed particularly well using the thrust wire winding technique, since only low mechanical loading of the housing parts 20, 21 occurs during the winding of the housing parts 20, 21.

The component 1 can have further components that are mounted without adhesive, for example, insulation elements. For example, a separating element 22 is arranged between the windings 6, 7, said separating element ensuring the isolation of the windings 6, 7 from one another. For example, the separating element 22 is designed in the form of a separating ridge. The separating element 22 can be embodied as a constituent part of the mounting device 3 or be secured to the mounting device 3. In particular, the separating element 22 can be latched to the mounting device 3 by further latching elements (not shown). Alternatively, the separating element 22 can be embodied as part of the housing 5 or secured to the housing 5, for example, by latching elements.

Figure 2:
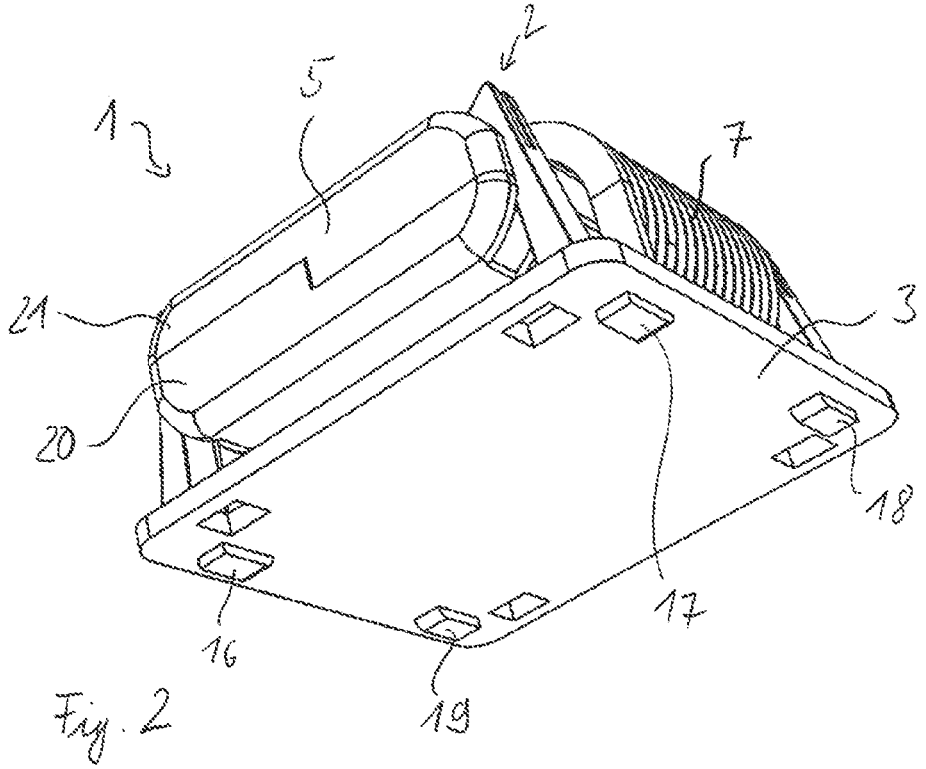
FIG. 2 shows a further embodiment of a component in a view obliquely from below.

FIG. 2 shows a further embodiment of a component 1 in a view obliquely from below.

The component 1 differs from the embodiment shown in FIGS. 1A and 1B by the design of the electrical connections. In particular, the connections are embodied here for SMD mounting. The connection elements 16, 17, 18, 19 are thereby fed through holes in the mounting device 3 and bent on the underside of the mounting device 3. The component 1 can therefore be secured to a printed circuit board by surface mounting.

A method for producing the component 1 of FIGS. 1A, 1B and 2 is described in more detail below. The windings 6, 7 are thereby produced using a thrust wire winding technique. In this case, the core 4 is inserted into a receiving region of a winding apparatus. The core 4 can be embodied without a housing. Alternatively, the core 4 is arranged in a housing 5. For example, the housing 5 has a plurality of separate housing parts 20, 21. In this case, the housing parts 20, 21 preferably only abut one another but do not have any further fastening.

A wire is inserted into a guide of the winding apparatus and thrust forwards. The guide has, for example, a rectilinear section and a curved section. The wire is thrust forwards through the rectilinear section and then runs against a wall of the curved section, thereby bending the wire. The wall of the curved section thus functions as a bend-imparting means for the wire. By thrusting the wire further, the wire is guided around the core.

In addition to bending the wire in the plane, a slope of the wire is generated out of the plane. For this purpose, the guide has a corresponding slope, for example. The wire is further thrusted forwards such that the wire screws around the core until the entire winding is generated. A further winding can be applied simultaneously or after the first winding has been generated.

The winding apparatus is embodied, for example, such that the wire does not come into contact with the housing and/or the core during the winding process. Alternatively, the wire can be wound around the housing or the core in a form-fitting manner. In this case, separate housing parts can be held together particularly stably by the windings.

In a further method step, the wire ends are bent out of the basic shape of the winding in order to form connection elements. For this purpose, the winding apparatus has one or more deformation elements, which are embodied, for example, as plates or fingers. A deformation element is pressed against the wire end and bends said wire end out of the winding.

In an alternative embodiment, one or more separate connection elements are secured, for example, soldered, to the wire ends.

Subsequently, the wound core 4 is removed from the winding apparatus and secured to the mounting device 3. For this purpose, the core 4 provided with the windings 6, 7 is placed onto the mounting device 3, wherein the connection elements 16, 17, 18, 19 are fed through holes in the mounting device 3. The core 4 provided with the windings 6, 7 latches with a latching device 2 during placement onto the mounting device 3.

A separating element 22 for isolating the windings 6, 7 from one another can already be arranged on the housing 5 during the formation of the windings 6, 7 or can be embodied as part of the housing 5. Alternatively, the separating element 22 is secured to the mounting device 3 or is formed as part of the mounting device 3. Alternatively, after the core 4 has been fitted, the separating element 22 can be arranged between the windings 6, 7. For example, the separating element 22 is fitted and latched to the housing 5 or the mounting device 3.

The invention claimed is:

1. An inductive component comprising:

a mounting device;

a magnetic core;

at least one winding of a wire wound around the magnetic core;

a latching device, wherein the core is secured to the mounting device by the latching device; and a housing for the core, wherein the housing has at least one opening into which the latching device engages, and wherein the latching device engages directly on the core through the opening in the housing.

2. The component according to claim 1, wherein the mounting device comprises latching elements with which the core is secured to the mounting device.

3. The component according to claim 2, wherein the latching elements abut at an upper side of the core and/or the housing.

4. The component according to claim 2, wherein the latching elements are embodied as latching arms.

5. The component according to claim 1, wherein the winding sits loosely on the core or the housing.

6. The component according to claim 1, wherein the winding is formed by thrusting forward a wire along a curved wall of a winding apparatus.

7. The component according to claim 1, wherein the component has at least one electrical connection element, and wherein the connection element is guided through the mounting device.

8. The component according to claim 1, wherein the housing comprises a plurality of housing parts, and wherein the housing parts are held together by the winding.

9. The component according to claim 1, wherein the component has at least two windings, and wherein at least one separating element is arranged between the windings.

10. The component according to claim 9, wherein the separating element is secured to the housing and/or the mounting device without an adhesive.

11. The component according to claim 1, wherein the component is embodied for PTH mounting or for SMD mounting.

12. The component according to claim 1, wherein the opening extends from an upper side of the core which faces away from the latching device up to a lower side of the core which faces towards the latching device.

* * * * *